United States Patent [19]

Ratelband

[11] 4,304,216

[45] Dec. 8, 1981

[54] FIRE-GUARD

[76] Inventor: John B. Ratelband, Utrechtsestraat 55-34, Rynstateflat,6811 LV Arnhem, Netherlands

[21] Appl. No.: 105,566

[22] Filed: Dec. 20, 1979

Related U.S. Application Data

[63] Continuation-in-part of Ser. No. 86,768, Oct. 22, 1979, abandoned.

[51] Int. Cl.[3] ..... F24B 7/00

[52] U.S. Cl. ..... 126/121; 126/140; 126/202; 160/DIG. 9; 160/351; 165/171; 165/172; 237/79; 432/247; D7/208

[58] Field of Search ..... 126/138, 140, 202, 121; 160/DIG. 9, 351; D7/208; 165/168, 169, 171, 173, 128, 129; 432/65, 247; 237/79

[56] References Cited

U.S. PATENT DOCUMENTS 4,217,094 8/1980 Crowley ..... 432/65

FOREIGN PATENT DOCUMENTS 1344299 8/1962 France ..... 126/121
197465 5/1923 United Kingdom ..... 126/121
901860 7/1962 United Kingdom ..... 126/121

*Primary Examiner*—Samuel Scott
*Assistant Examiner*—Randall L. Green
*Attorney, Agent, or Firm*—Sheridan, Ross & McIntosh

[57] ABSTRACT

A device is provided for heating a room by convection using the heat from a conventional radiation heat source. The heating device further acts as a fireplace guard when the heat source is a fire to substantially prevent sparks or other small particles of combustion from entering the room in which the fireplace is located. The device includes a threshold unit and a plurality of spaced pipes. The pipes are supported by the threshold unit while a screen member such as metal gauze is connected between the pipes. An opening in the threshold unit is adjacent the floor surface of the room in which the heat source is located. The radiation from the heat source raises the temperature of the pipes while relatively cool air enters the opening in the threshold unit and passes into the pipes. The temperature of the air is increased by the heated pipes and exits from the top thereof to heat the room by convection. The threshold unit can comprise a number of separate units which are joined together by a hinge construction so that the length of the threshold unit can be varied and also to permit access to the radiant heat source.

4 Claims, 30 Drawing Figures

FIG. 1
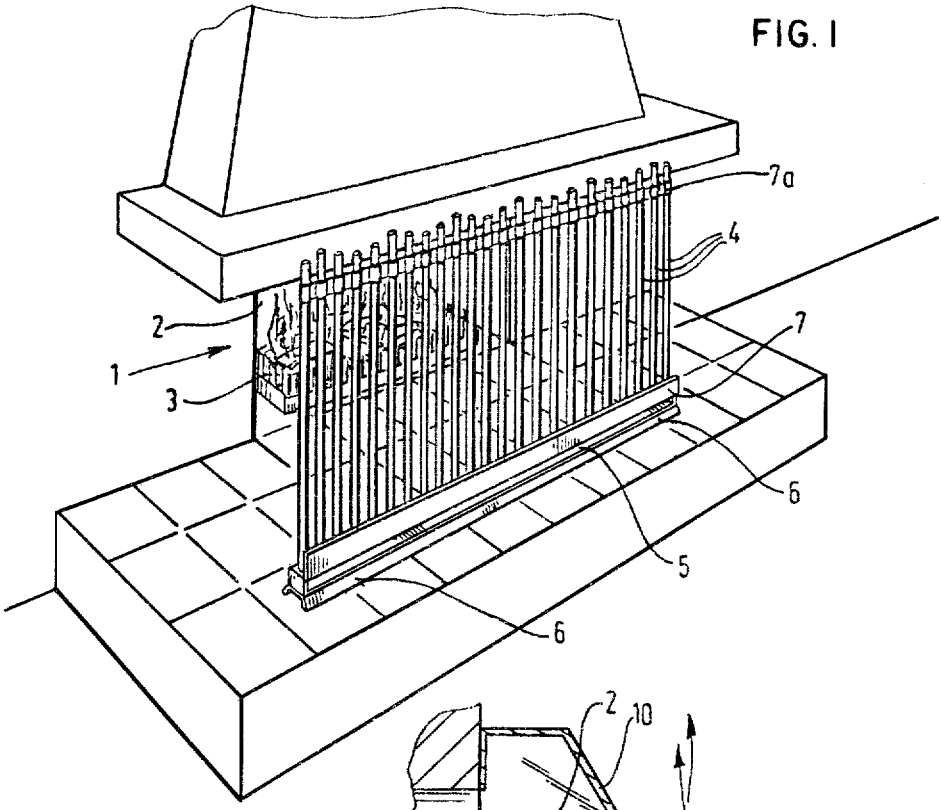
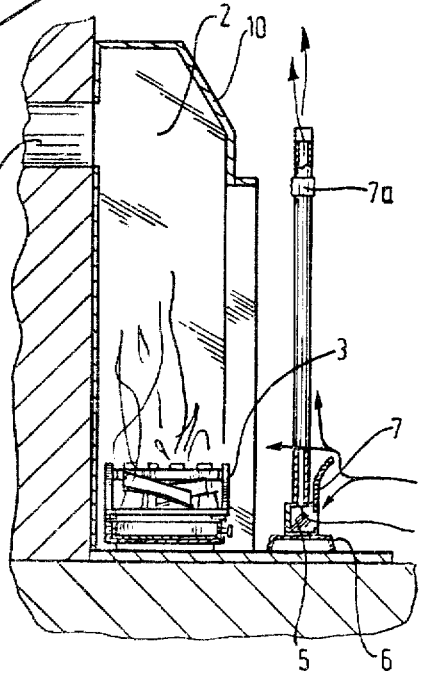
FIG. 2

FIG. 3
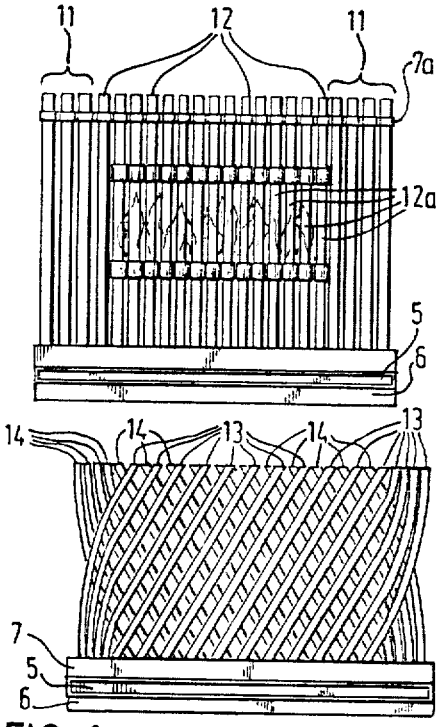
FIG. 4
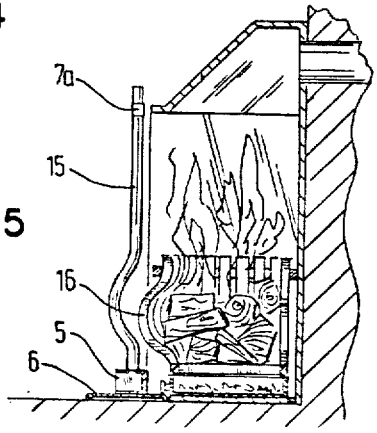
FIG. 5
FIG. 6
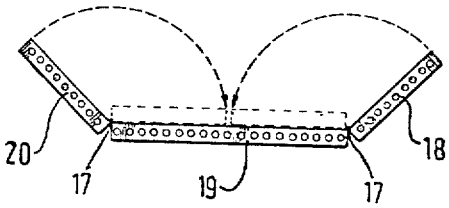
FIG. 7
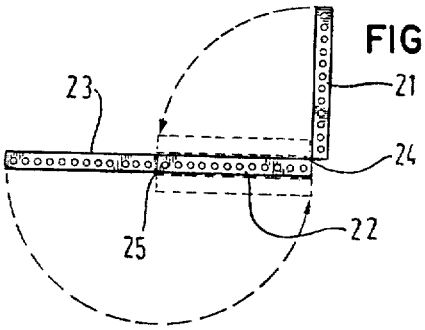
FIG. 8
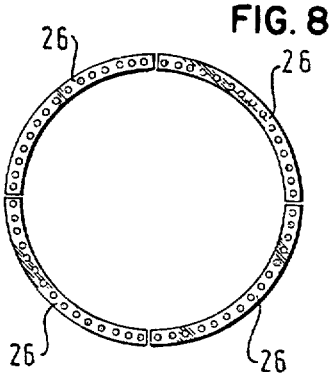

FIG. 17
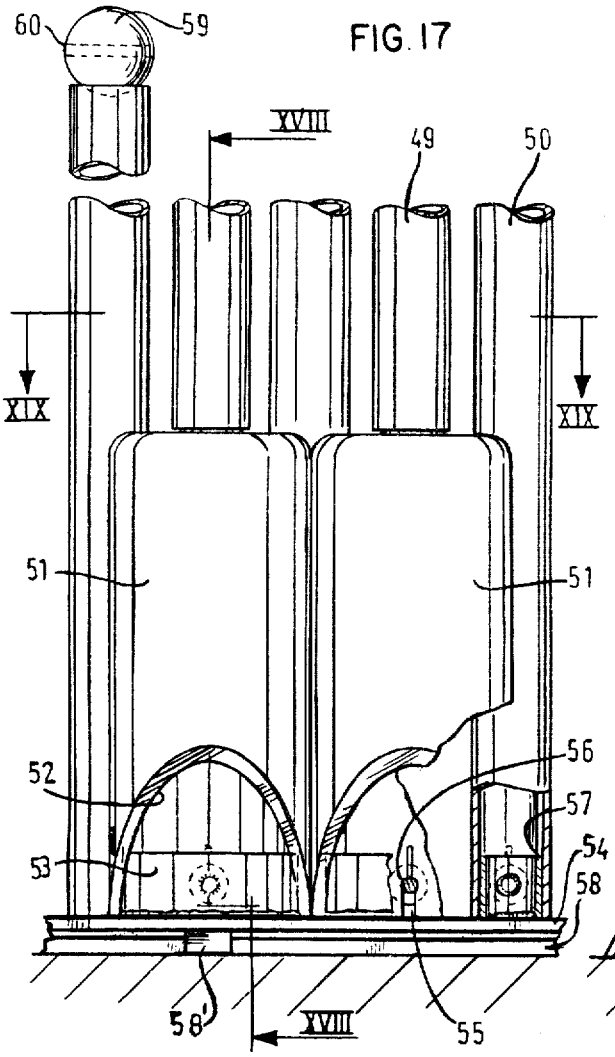
FIG. 18
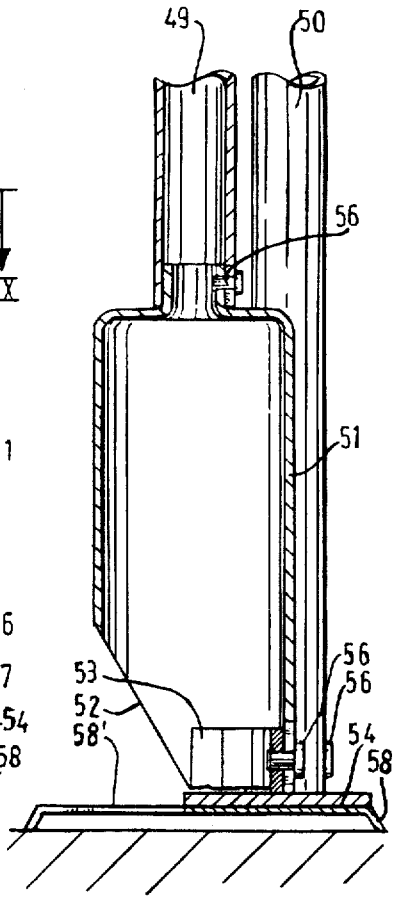
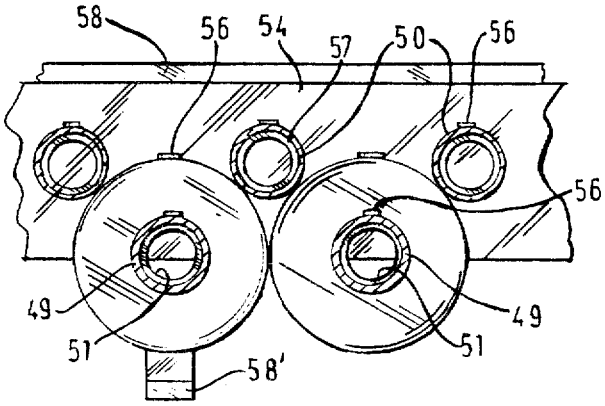
FIG. 19

FIRE-GUARD

This application is a continuation-in-part of my co-pending patent application, entitled "Fire-guard", Ser. No. 086,768, filed Oct. 22, 1979 and abandoned.

BACKGROUND OF THE INVENTION

The invention relates to a movable fire-guard used to be placed in front of the opening of the fire-space of an open fire, fire-grate, gas-fire or an electric radiant heater. The fire-guard not only arrests flying sparks and leaves the fire still visible but also distributes the heat generated in the room to be heated by the fire in a more agreeable way over the space of said room.

With the increasing concern over the depletion of energy resources, a variety of worthwhile and economical energy conserving devices have been devised. In this regard, fireplace convection heaters have been developed. In U.S. Pat. No. 3,368,545 to Ibbitson a hinged fireplace guard is described. Air enters through a lower inlet thereof and passes upwardly due to convection and exits through an outlet. Air can be introduced through openings to provide combustion air to the fire behind the fireplace guard. In U.S. Pat. No. 4,112,915 to Slavik a fireplace heater is described in which air drawn in by conduction moves into a heating chamber. The heating chamber includes conduits for communicating with openings in a fireplace guard which release the heated air.

SUMMARY OF THE INVENTION

According to the invention the object aimed at is attained in that the fire-guard is provided with at least one row of spaced apart pipes which each extend from a given level above the base of the guard to a higher level and are so secured to one another as to form a grid-shaped screen. These pipes receive the radiation energy escaping from the fire into the room and convert said energy escaping from the fire into the room and convert said energy into heat to heat the air contained in the pipes. The result thereof is that the pipes operate as chimneys, consequently, suck cooler air out of a layer lying just above the floor, heat said air and return at their upper ends the heated air into the room. Produced thereby in the room is a circulation of air, which distributes the heat generated by the radiation energy over the room in a way which is agreeable to the person or persons who is (are) in the room. Another advantage of this fire-guard is that it is very much cooled by the currents of air produced in the pipes, so that one cannot burn oneself when touching the guard, as is possible with the known guards consisting of gauze.

It is observed that one has already proposed in the U.S. Pat. No. 3,368,545 to use the heat of the flue-gas flowing along the doors of the furnace of a stove and the heat of the radiation of the fire falling on said doors for heating the air in cavities made in the doors and being in open communication with the room to be heated both at their lower and their upper ends. Also these cavities operate as chimneys and produce a circulation of heated air in the room. However, in this case it is not a question of a movable fire-guard, which, when it has the right shape and dimensions, can be disposed in front of an existing fire-place or put aside, when its use is not desired, but of a permanent part, viz. a door or doors of a stove. The problem, how the radiation emitted by the fire and escaping through the opening of the open fire-place, said radiation often heating the persons, who are present in the room, on their sides facing the fire-place too strongly and on their sides remote from the fire-place not at all, could be used with greater efficiency for an even and all-round heating of said persons, is not solved in that patent disclosure.

It has appeared that in many cases the effect of the fire-guard and the visibility of the fire can be improved, when the guard is provided with at least two rows of pipes which are situated one behind the other. If then all pipes of the guard should be parallel to one another, it is recommended to dispose the pipes of each row and those of the or any other row in horizontal staggered relation. However, it is also possible to construct the fire-guard, in such a way, that the pipes of each row and those of the or any other row cross.

In order to maintain in an extremely efficient fire-guard, consequently, in a guard having many pipes per unity of width of the guard, the visibility of the fire the guard may have a number of pipes which at least partly consist of transparent material. One must then keep in mind that transparent pipes are less adapted to convert radiation emitted by a fire into heat than opaque pipes and that dull black pipes take in more radiation than shiny metal pipes, which reflect a great part of the radiation energy.

In order to facilitate the suction of air by the pipes of the fire-guard the latter may be constructed in such a way, that each pipe is connected at its lower end with a space which is closed at the back of the guard and open at the front thereof. In that case the unfavorable influence of the suction force exerted by the chimney draft on the air in the vicinity of the inlet openings of the pipes will transport more air. This effect can still be increased, when the lower portion of the guard extending over a predetermined height is so impenetrable, as to form a threshold for the air flowing through the spaces left between the pipes. This threshold assures that a part of the combustion air sucked by the chimney into the fire is preheated.

A simple construction of the fire-guard is possible, as the threshold consists of a strip which extends throughout the width of the guard. The threshold may also consist of two clamping strips clamping the pipes in a row and extending throughout the width of the guard. Then, the threshold serves at the same time to fix the pipes. Furthermore, the threshold may advantageously consist of pieces of tubing which extend throughout the height of the threshold, lie transwisely one against the other and are open at or near their lower ends, said pieces of tubing having each a greater diameter than that of the pipes of the guard and joining each of the pipes at their upper ends.

If, irrespective for which reasons, the pipes of the guard are spaced apart at greater distances than is required for a reliable screening, gauze may be provided at least in the spaces left between the pipes in a row of pipes. The construction of such a guard will be simple, if the entire area of the fire-guard is covered by gauze, against which the pipes spaced apart at the desired distances are mounted.

Should the fire-guard be composed of at least one pair of parts which are hinged to one another and adapted to pivot one in respect of the other about a vertical axis, the guard may be folded or rolled up, when the pivots of the hinges are suitably arranged, so that the guard can be easily set aside. The hinge-connection between the pipes of a pair of adjacent pipes of the guard can be advantageously constructed in such a way, that one pipe of a or each pair of adjacent pipes is provided with at least two coaxial eyes and the other pipes of said pair is provided with hooks fitting said eyes. After all pipes of the fire-guard have been interconnected in pairs in this manner, the guard can be bent in many shapes and in the condition of a number of separate pipes, a base plate and a threshold member, if any, it can be easily packed and dispatched. Moreover, the width of the guard can be easily adapted to any fire-place by connecting more or less pipes. In this case each pipe is provided on its one side with eyes and on its other side with hooks.

The hinge-connection between two adjacent pipes may also consist locally of two rings, each of which is mounted on its own pipe, clamped or screwed thereon and provided with a radially extending eye, of which eyes at least one of one ring and one of the other ring overlap each other, in such a manner, that their holes are coaxial, and of a pivoting pin or bolt which extends through said holes. The rings provided with eyes may each be secured to a pipe by means of a self-tapping screw.

A combination of threshold and hinge-connection is obtained, if provided between the two pipes of a pair of adjacent pipes is a hinge which extends in the lower part of the guard over a predetermined height and is so impenetrable, as to form a threshold for the air flowing through the spaces left between the pipes.

If it is desired to decrease or to stop entirely the rising flow of air in a pipe of a fire-guard placed in front of a burning open fire, fire-grate, gas-fire or an electric radiant heater, this could be easily done by placing on top of the upper end of said pipe a body which narrows or closes the outlet opening of the pipe. Should the fire-guard consist of round pipes a bead or a marble of which the diameter is greater than the inner diameter of the pipe could be used to that purpose.

From the foregoing, the present invention affords a number of worthwhile advantages. A fire-guard device is provided which protects against the exiting of products of combustion from a fireplace and by convection also heats the room in which the fireplace is located. The device also permits persons to position themselves very near the fireplace since a significant part of the radiation heat emitted by the fire is absorbed by the pipes, rather than passing thereby to be directly sensed by a person adjacent the fireplace. Furthermore, an adjustable member may be placed over the bottom end of each pipe so that the amount of cool air entering therein is regulatable. Consequently, the larger the entrance opening for the cooler air from adjacent the floor surface, the lower the temperature of the pipes and the closer a person may be positioned near the fireplace without feeling uncomfortable due to the radiant heat.

Unlike conventional fireplace guards which become very hot from the radiation heat of the fire, the temperature of the air-passing pipes is lower than or substantially equal to the temperature of the room in which the fireplace is located since the radiant heat energy is quickly absorbed by the air which continues to exit while cooler air constantly enters the pipes. Thus, the possibility that a person will be burned upon inadvertently contacting the heating device is substantially prevented.

Since the draft of the chimney removes smoke and flames away from the device which is placed outside the fireplace, the device remains relatively clean through constant use. In addition, the arrangement of the pipes permits the fire to be viewed and this feature is enhanced considerably when the pipes are made of a transparent material, such as glass. Air from the room containing the fireplace can also pass between the pipes into the fireplace but this air is first preheated by the radiation heat of the pipes prior to entering into the fireplace. This air is sufficient to assure proper combustion in the fireplace. An alternative embodiment of the heating device might include a pair of rows of pipes in which a second row is positioned in offset relationship behind the first row so as to absorb more of the radiant heat energy for heating the air and allowing less to pass directly into the room. Finally, the hinge construction interconnecting the pipes readily facilitates the use of the device with a variety of fireplaces and other radiation heat emitting units. Inasmuch as pipes can be added to or removed from the threshold plate, the device is adaptable for various sizes and contours of fireplaces. Additionally, the hinges permit pivotal movement of the device, or portions thereof, to allow access to the fire. The hinge arrangement also permits the device to be easily disassembled so that it can be transported elsewhere.

Additional advantages of this invention will be readily apparent from the description which follows taken in conjunction with the accompanying drawings.

BRIEF DESCRIPTION OF THE DRAWINGS

FIG. 1 is a view in perspective of a fire-place and a fire-guard placed according to the invention placed in front thereof;

FIG. 2 is a vertical sectional view of a fire-place and a fire-guard placed in front thereof;

FIG. 3 is a front view of a fire-guard provided with pipes, of which a portion is transparent;

FIG. 4 is a front view of a fire-guard provided with crossing pipes;

FIG. 5 is a vertical sectional view of a fire-place and a fire-guard placed in front thereof and consisting of curved pipes;

FIG. 6 is a plan view of a collapsible fire-guard;

FIG. 7 is a plan view of another collapsible fire-guard;

FIG. 8 is a plan view of a circular fire-guard composed of separate parts;

FIG. 17 is a partly taken away front view of a variant of the fire-guard provided with two rows of pipes;

FIG. 18 is a vertical sectional view taken on line XVIII—XVIII shown in FIG. 17;

FIG. 19 is a horizontal sectional view taken on line XIX—XIX shown in FIG. 17;

DETAILED DESCRIPTION OF THE INVENTION

Figure 10:
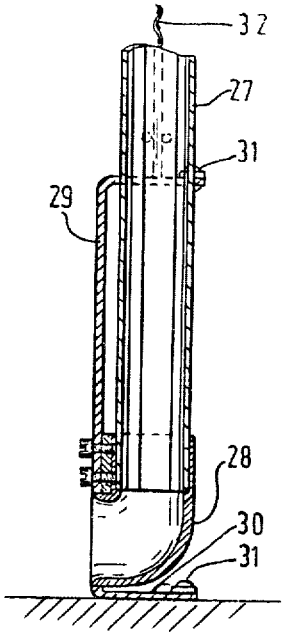
FIG. 10 is a vertical sectional view taken on line X—X shown in FIG. 9.

In FIG. 1 a fire-place is designated by 1 and it has a fire space 2 and a grate 3. Placed in front of the fireplace is a guard which consists of a row of vertical metal pipes 4 spaced apart at short distances. These pipes are attached to and communicate with the inner space of an oblong box 5 lying on its side, of which the open side faces the front and the bottom faces the back of the fire-guard. The box 5 is mounted on a base plate 6, which obstructs the flow of air below the fire-guard as much as possible. Just above the opening of the box 5 and in front of the pipes there is provided a screening or threshold strip 7 which extends throughout the entire width of the guard. Near their upper ends the pipes are interconnected to form a guard by clamping strips 7*a*. The pipes 4 are so long as to protrude upwards beyond the upper edge of the fireplace opening or should the fire-place, as is shown in FIG. 1, be surrounded by a mantelpiece 8 beyond the lower surface of the mantelshelf. It appears from FIG. 1 that the pipes 4 need not be equally long.

If the pipes 4 are hit by the radiation of the fire, they and the air contained in them are heated, so that the pipes will start to operate as chimneys, consequently, will suck cooler air from the layer of air near the floor of the room to be heated, heat this air and return at their upper ends to the heated air into the room. Due thereto there is produced in the room a circulation of heated air which is agreeable to the persons present in the room. Consequently, the fire-guard does not only arrest flying sparks from the fire, screen-off the often very strong radiation and prevent one to touch the hot grate and the fire, but has at the same time the task to so convert the otherwise insufficient radiation energy into heat to be given off to the air in front of the fire-place, as to ensure that the air circulation which is so important for the even heating of the air contained in the room automatically occurs. The latter effect appears to be reinforced by the threshold strip 7 which on one hand facilitates the inflow of cooler air into the box 5 and on the other hand leads upwards and preheats the air sucked by the chimney which is connected to the fire-place, so that a portion of said air will flow upwards along the outside of the pipes and will join the air circulation in the room and the remaining portion of said air will be sucked as preheated combustion air into the fire. It will be apparent that the most efficient conversion of radiation energy into heat is achieved when the pipes are black. The fire-guard is so effectively cooled by the strong air current in the pipes thereof that it is not possible to burn one-self, when touching it even when the radiation is very strong.

In FIG. 2 the fire-guard shown in FIG. 1 is placed in front of a movable open stove 10 which is connected to a chimney opening 9. In this guard the threshold strip 7 is slanting forwards and upwards to improve further the inlet of air.

FIG. 3 illustrates a fire-guard of pipes 11 and 12 which are equally long and of which pipes 12 have intermediate portions 12*a* of glass or other transparent material. The fire is then well visible. As glass and the air contained therein let most of the radiation pass, the pipes provided with glass portions are less effective.

The fire-guard shown in FIG. 4 consists of two rows of pipes 13 and 14, said rows being situated one behind the other. The pipes 13 of one row and those 14 of the other row cross.

FIG. 5 shows that the pipes need not be straight. In this embodiment of the guard the pipes 15 follow the curved shape of the grate 16. The threshold is absent in this embodiment.

The fire-guard illustrated in FIG. 6 consists of three parts 18, 19, 20, which are pivotally interconnected at 17, so that the guard may be collapsed to form two layers and it is adapted to be used in the shown condition.

The fire-guard shown in FIG. 7 consists also of three parts 21, 22, 23. The hinges 24 and 25 between these parts are mounted at the back and at the front of the guard, so that this guard may be collapsed to form three layers or may be used in the illustrated condition in front of a fire-place having two open sides.

The circular fire-guard shown in FIG. 8 is composed of four individual parts 26, which each have the shape of a quarter circle. This guard is placed around a round fire-place which is open on all sides and is found in the center of the room to be heated.

Figure 9:
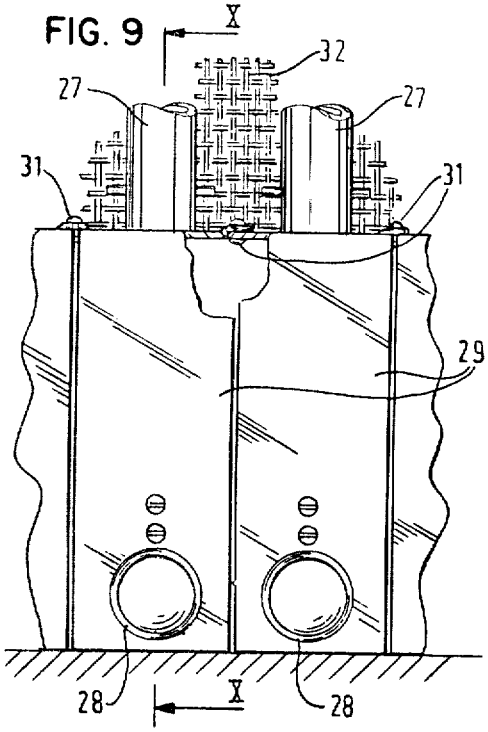
FIG. 9 is a front view of still another fire-guard.

FIGS. 9 and 10 relate to a fire-guard which is composed of rather widely spaced apart pipes 27 which are each connected to their own knee 28 which is open towards the front. Each pipe is provided with its own threshold plate or strip 29, of which a lower end portion is bent backwards to form a foot 30, which is pivotally connected at 31 to the foot of an adjacent pipe. Also an upper end portion of the threshold plate is bent backwards. This end portion supports the pipe in question and it is pivotally connected at 31 with the backwards bent upper end portion of the threshold plate 29 of each one of the adjacent pipes 27. Flexible metal gauze 32 is mounted between the pipes. This guard is adapted to be brought into many shapes, so that it may be used with a round fire-place as shown in FIG. 8 or with a fire-place which is open on two sides.

Figure 12:
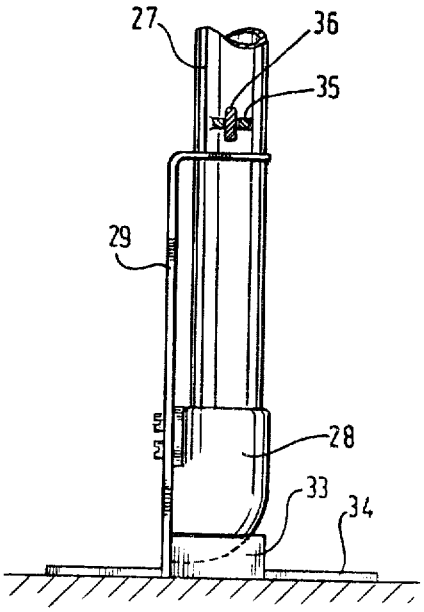
FIG. 12 is a vertical sectional view taken on line XII—XII shown in FIG. 11.
Figure 11:
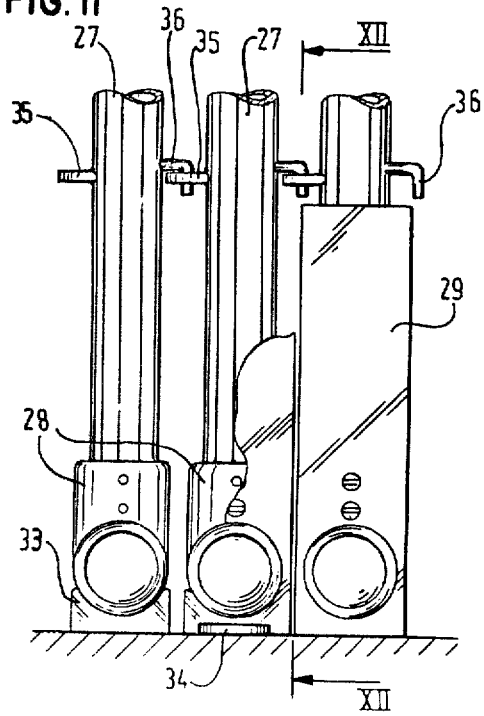
FIG. 11 is a front view of a portion of a variant of the fire-guard shown in FIGS. 9 and 10.

The fire-guard illustrated in FIGS. 11 and 12 is a variant of that shown in FIGS. 9 and 10. The pipes 27 having each their own knee are mounted closer together, so that it is not necessary to fill the openings left between the pipes with metal gauze. Each knee rests on the floor with a foot 33. In order to protect the fire-guard against falling over, there are attached to the feet 33 of some of the pipes of the guard transverse strips 34, which engage recesses formed in the lower surface of the feet in question. The threshold plates 29 of the pipes are not only bent backwards at their upper ends to support the pipes. Each pipe is provided on one side with coaxial eyes 35 welded thereon on different levels and on the other side with hoods 36 welded thereon on nearly the same levels and fitting said eyes. Owing to the hooks and eyes the pipes are detachably pivotally interconnected. This construction makes it possible that the guard is placed in many curved shapes, the width of the guard is changed as desired and the guard is packed and set aside as a bundle of separate pipes with accessories. Moreover, damaged pipes can be easily replaced by others.

Figure 14:
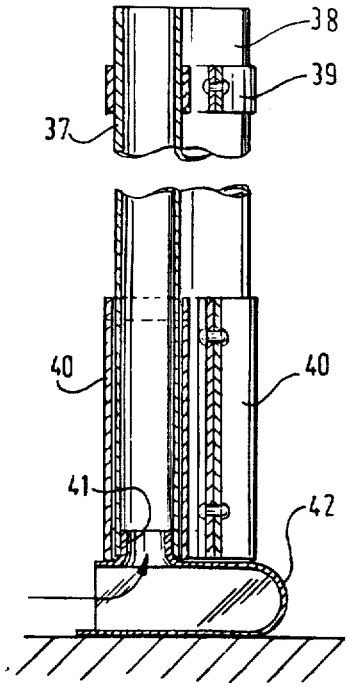
FIG. 14 is a vertical sectional view taken on line XIV-XIV shown in FIG. 13.
Figure 13:
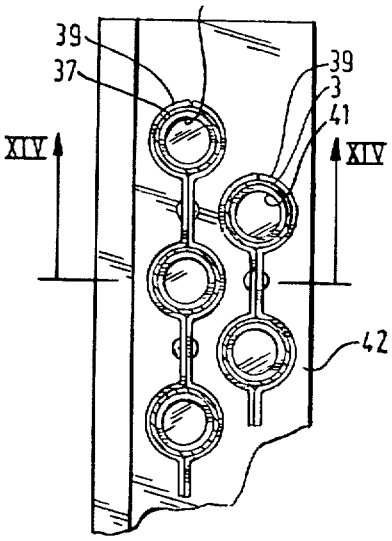
FIG. 13 is a plan view of a portion of a fire-guard provided with two rows of pipes.

FIGS. 13 and 14 show a fire-guard consisting of two rows of pipes 37 and 38. The pipes 37 of the front row on one hand and the pipes 38 of the back row on the other hand are placed in staggered relation of one half of the distance between the pipes. The pipes are interconnected by horizontally extending clamping strips 39 and 40. The clamping strips 40 are so high that they form at the same time a threshold plate. The pipes 37 and 38 are slid over upwards pointing pieces of tubing 41 formed on a base member 42 having a cross section in the shape of a lying U.

Figure 15:
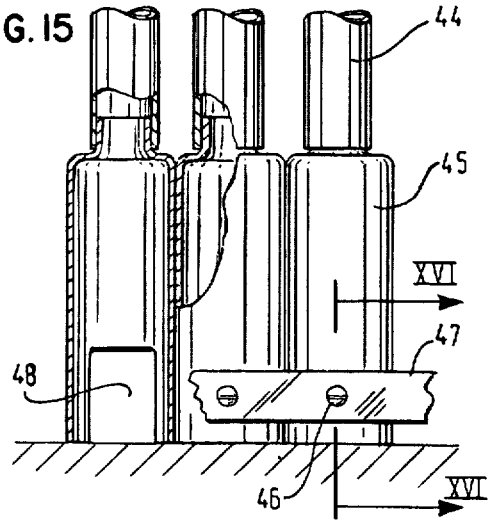
FIG. 15 is partly a vertical longitudinal sectional view, partly a rear view of a portion of a still differently constructed fire-guard.
Figure 16:
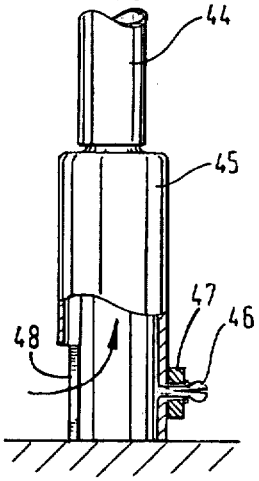
FIG. 16 is partly a vertical sectional view taken on line XVI—XVI shown in FIG. 15, partly a side view of the fire-guard illustrated in FIG. 15.

The fire-guard illustrated in FIGS. 15 and 16 consists of pipes 44 which are slid over pieces of tubing 45 having threshold height. The diameter of each one of these pieces of tubing 45 is so much greater than that of the pipes, that, when they lie one against the other, the pipes are spaced apart at the exact distances. The pieces of tubing 45 standing next to one another form both the threshold and the foot of the guard. The pieces of tubing 45 are provided with pins 46 welded thereto, on which a perforated horizontal bar 47 for the interconnection of the pieces of tubing is mounted by snap action. Furthermore, the pieces of tubing 45 have each on their front side an air inlet opening 48.

FIGS. 17, 18 19 represent a fire-guard which has a double row of pipes 49, 50. The pipes 49 of the front row are slid over pieces of tubing 51 lying one against the other and having a greater diameter. These pieces of tubing 51 are on their front side and at their lower end obliquely cut to form inlet openings 52. They are fixed on half-circular upright strips 53, which are attached to a base plate 54. At their backs the pieces of tubing 51 have vertical slots 55 which are open at their lower ends and by means of which they are slid over pins 56 provided with heads and welded to the upright strips 53. The pipes 50 of the back row are slid in the same detachable manner over and secured to upright pieces of tubing 57 which are attached to the base plate 54. Also the pipes 49 are secured to the pieces of tubing 51 in the same way. Instead of slots 55 and pins 56 holes and self-tapping screws or other means for the detachable connection may be used. The base plate 54 rests on a plate 58, which is open on the front side of the guard and is provided with some forward pointing supporting strips 58' only. This guard can be easily disassembled and packed and set aside as a bundle of pipes and strips.

If it be desired to use the fire-guard without the strong air circulation generated thereby or should it be desired to restrict the circulation, it is possible to put on all pipes or only on a part of the number of pipes of the guard a marble or a bead 59, 60 (FIG. 17). When the shown bead 59 is turned with its hole 60 over an angle of 90°, the outlet opening of the pipe in question is narrowed instead of closed.

Figure 20:
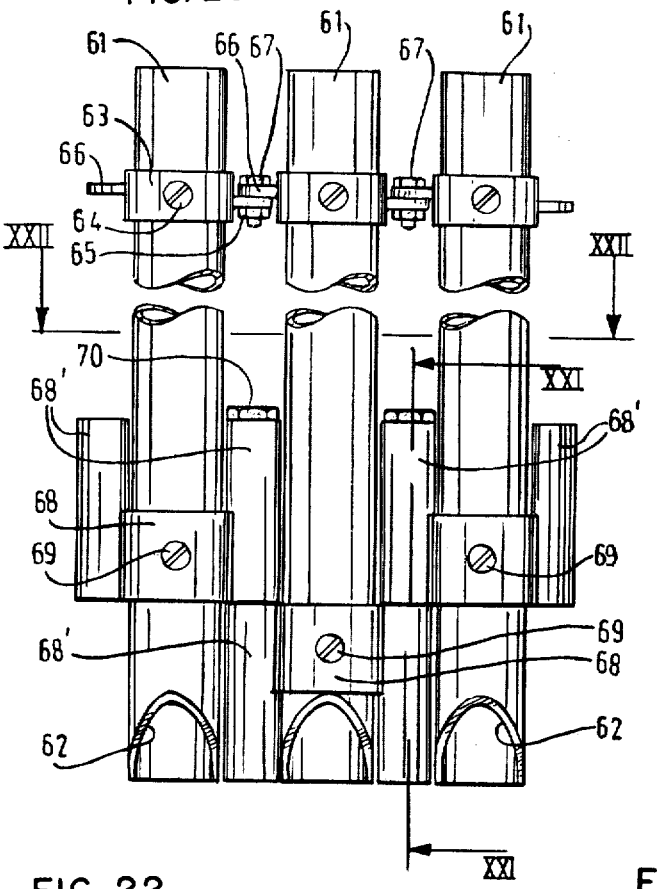
FIG. 20 is a front view of a portion of a variant of the hinged fire-guards.
Figure 21:
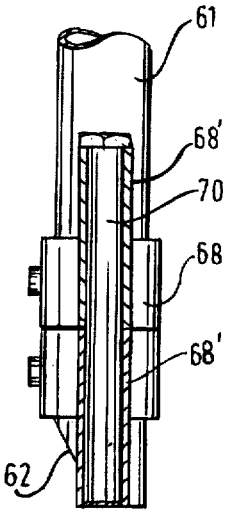
FIG. 21 is a vertical sectional view taken on line XXI—XXI shown in FIG. 20.
Figure 22:
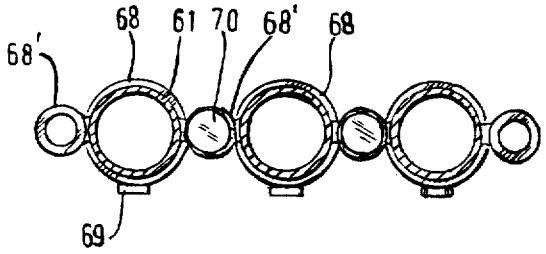
FIG. 22 is a horizontal sectional view taken on line XXII—XXII shown in FIG. 20.

The guard shown in FIGS. 20, 21, 22 consists of pipes 61 which have at their lower ends forward directed openings 62 for the intake of air, said openings being made by obliquely cutting said lower pipe ends. Near its upper end each pipe is provided with a ring 63 which has been slid over the pipe in question and is fixed thereto by a self-tapping screw 64. Each ring 63 is provided with two diametrically opposite eyes 65 and 66, such that one eye 65 is attached to the ring on a somewhat lower level than the other eye 66, so that the eyes of two adjacent rings 63 come to overlap and to lie with their holes in coaxial relation. A pivot or bolt 67 extends through the coaxial holes.

A threshold composed of pivotally interconnected elements 68, 68' extends over a given height along a lower end portion of the pipes 61. These elements consist each of a relatively low annular part 68 and tubular hinge members 68' welded or soldered to the part 68 in diametrically opposite places and having a height which is half that of the threshold. The elements 68, 68' are alternatingly with their tubular members 68' pointing upwards and downwards attached to the pipes 61 by self-tapping screws 69 on levels which differ in such a manner that in the space left between the pipes of each pair of adjacent pipes a tubular member of one pipe and a tubular member of the other pipe of the pair in question join each other coaxially and form between said pipes a threshold. Furthermore,. said tubular members are interconnected by a pivot 70. This fire-guard is adapted to be placed in many different shapes, e.g., into a zigzag line in front of the fire-place.

Figure 23:
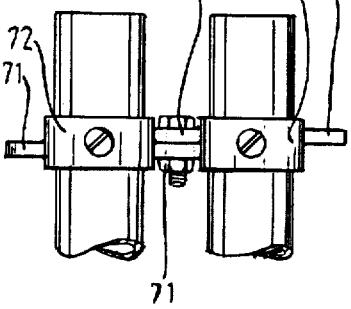
FIG. 23 is a front view of a variant of a hinge-connection between the pipes of the fire-guard illustrated in FIGS. 20, 21 and 22.
Figure 24:
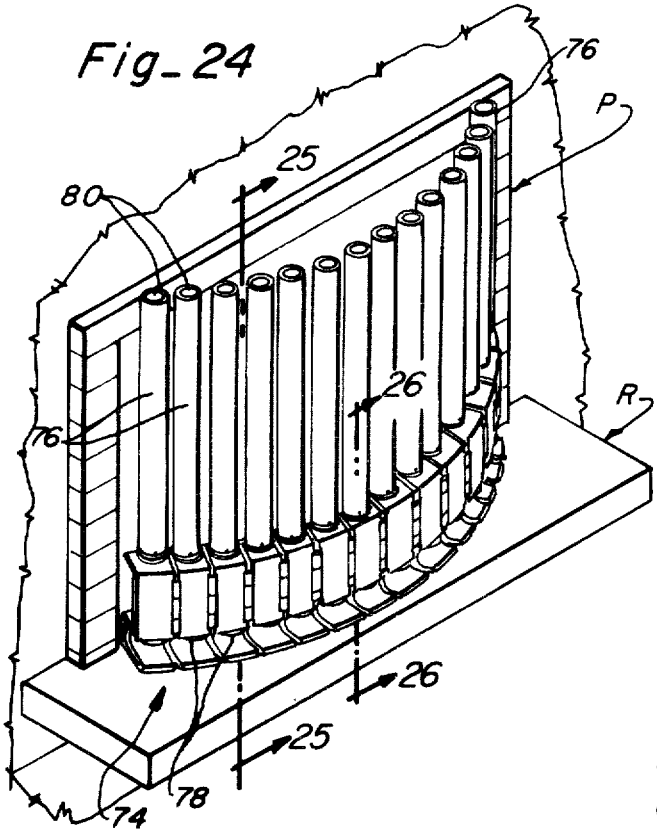
FIG. 24 is a perspective view of another embodiment of the fire-guard outwardly adjacent a fireplace without a screen fireplace guard attached thereto.

The variant shown in FIG. 23 of the upper hinge of the guard illustrated in FIGS. 20, 21, 22 consists in that the two eyes 71 of each ring 72 are on the same level beside the central transverse plane of the ring. If a ring 72 is turned upside down in respect of an adjacent ring 72, the eyes will lie on different levels so that they overlap.

In a further embodiment, a fire-guard is provided including a hinge structure as depicted in FIGS. 24–27. The fire-guard is placed exteriorly of the fireplace P on a hearth R and includes a threshold plate or unit 74 supporting a number of spaced, generally vertically extending pipes 76. Each pipe 76 extends lengthwise over the top portion of the fireplace P and has a first or bottom open end 78 and a second or top open end 80.

Figure 25:
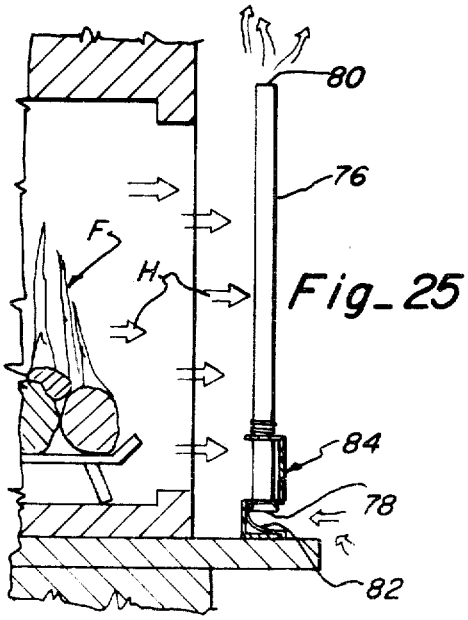
FIG. 25 is a longitudinal section, taken along line 25—25 of FIG. 24, indicating the flow of cooler air into the fire-guard, the heating thereof by the fire, and the exiting of the heated air.

As illustrated in FIG. 25, radiation heat H from fire F is emitted outwardly, as indicated by the arrows, and is absorbed by the pipes 76. Open channels 82 in the threshold plate 74 permit air, also illustrated by the arrows, to enter the bottom open ends 78 of pipes 76 and pass upwardly therethrough. This air entering the pipes 76 is at a relatively lower temperature than other air in the room containing the fireplace P since such air is adjacent the floor surface which supports the fireplace P. The radiantly heated pipes 76 heat the air as the air rapidly passes therethrough by convection. The heated air subsequently circulates throughout the room in which the fireplace P is located.

Figure 26:
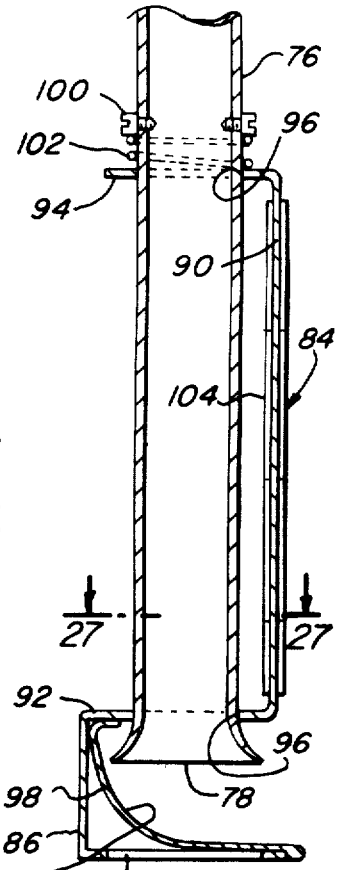
FIG. 26 is an enlarged, fragmentary, longitudinal section, taken along line 26—26 of FIG. 24, showing a portion of the fire-guard embodiment depicted in FIG. 24.
Figure 27:
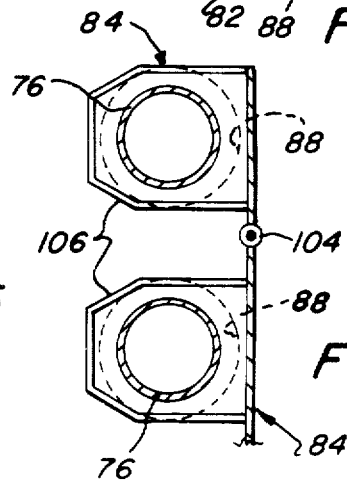
FIG. 27 is a fragmentary, lateral section, taken along line 27—27 of FIG. 26, showing further details of portions of the threshold unit, including a hinge construction.

As best seen in FIGS. 26 and 27, the threshold plate 74 includes a plurality of supporting units 84. Each of the supporting units 84 comprises a base member 86 having an aperture 88 formed therein. The supporting unit 84 overlies a supporting surface adjacent the heat source, such as the hearth R. A U-shaped member 90 is integrally joined to base member 86 and has a pair of spaced arms 92, 94. Each of the arms 92, 94 has an opening 96 axially alignable with each other and with aperture 88. A pipe 76 is instered through aperture 88 and then through openings 96. The pipe 76 is hollow and generally cylindrically shaped throughout its extension but is flared at its bottom open end 78 to facilitate the reception of air therein from the open channels 82. The flared bottom end 78 has a width substantially equal to the width of aperture 88 while the diameter or cross-sectional area of the remaining portions of pipe 76 is of a dimension substantially equal to openings 96. Since openings 96 are smaller than aperture 88, flared bottom end 78 cannot be inserted through openings 96. A curved flange 98 connected to the inner surface of base member 86 in open channel 82 also readily enables air to enter the bottom end 78 of pipe 76. A spring bolt 100 is fixedly held in both sides of each pipe 76. The spring portion 102 thereof surrounds an outer portion of the pipe 76 and engages arm 94 of U-shaped member 90. Pipe 76 is stabilizingly supported by this interconnection of spring bolt 100 and arm 94.

Figure 30:
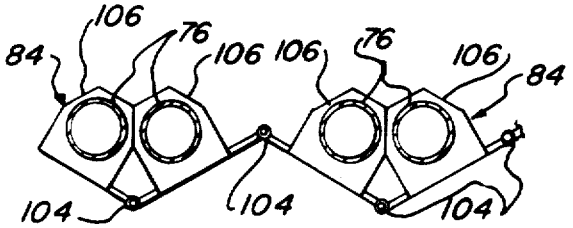
FIG. 30 is a fragmentary, lateral section, similar to FIG. 27, but showing portions of the threshold plate pivoted about the hinges.

A salient feature of the fire-guard is the pivotal interconnection of the supporting units 84 using hinge members 104 as shown in FIG. 27. The hinge construction permits pivotal movement of the supporting units 84 to allow access to the fire F. The generally rectangular shape with converging walls 106 of the supporting units 84 affords even greater pivoting movement, as seen in FIG. 30. The converging walls 106 of adjacent supporting units 84 are adaptable to abut flushly when pivoted together. The hinge members 104 can be positioned in a non-linear relation with respect to each other, such as a zigzag pattern, thereby reducing the overall length of the threshold plate 74 to expose the fire F. It is easily understood that this hinge arrangement provides simple and easy construction of the heating device. Further, supporting units 84 can readily be added to or removed from the threshold plate 74 at the hinge members 104 to compensate for different sizes of fireplaces. It is also apparent that the heating device could be hinged at the side walls of the fireplace so that the device is pivotable thereabout.

Figure 28:
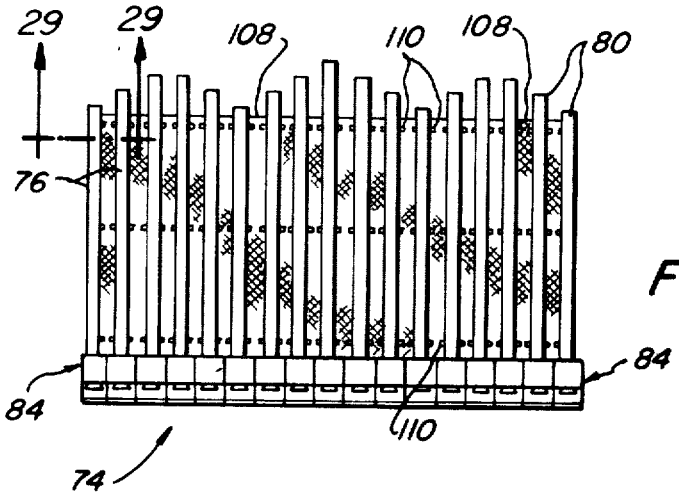
FIG. 28 is a front elevational view of the fire-guard showing the screen fireplace guard positioned between the pipes.
Figure 29:
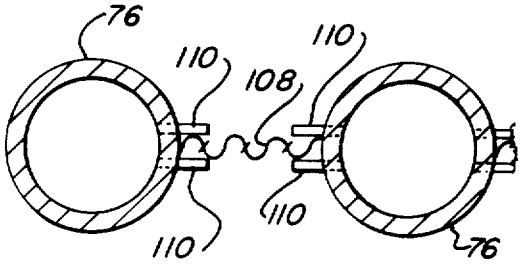
FIG. 29 is an enlarged, fragmentary, lateral section, taken along line 29—29 of FIG. 28, showing details of the screen connected to the pipes.

As illustrated in FIGS. 28 and 29, the fire-guard can also include a screen member 108 attached between the spaced pipes 76, by means of pegs 110 particularly where the radiant heat source is an open fire. The pegs 110 connect to and extend from diametrically opposite sides of the pipes 76. The screen member 108 is appropriate when the fire-guard is placed adjacent the fireplace P since it substantially blocks the path of sparks and other small particles of combustion emitted from the fire F.

Although the embodiments show only fire-guards provided with round pipes it will be obvious that the pipes may also have other cross sectional shapes. The bodies to close or to choke the pipes and to be placed to that end on top of the pipes must always have a shape corresponding to the form of the cross sectional area of the pipes.

Furthermore, it must be kept in mind that the fire-guard may also be used with other heat sources emitting much radiation energy, such as electric incandescent wires, gas or oil burners, etc.

Based on the foregoing description, this invention affords a number of beneficial advantages. A device is provided to receive relatively cool air and heat the same using radiant heat absorbed from a heat source, such as a fire-emitting fireplace. The heated air passes by convection and heats the room in which the heat source is located. A screen is included to substantially prevent the passage of small particles of combustion from the fire into the room and thereby reduce the possibility of a fire therein. The device is self-supporting and is placed exteriorly of the fireplace so that the device remains relatively clean and free of smoke and flame-causing debris since the draft of the chimney carries the smoke upward rather than having the debris contact the device.

The air-passing pipes are typically made of a strong heat-conducting material, such as aluminum or copper. The pipes may also be made of glass to permit more of the fire to be seen therethrough. In another embodiment, portions of the pipes may be made of a transparent material while the remaining portions of the pipes are made of metal. In addition, a pair of rows of pipes in offset relation can be provided to absorb even greater amounts of radiant energy. If the movement of air through the pipes is appreciably increased and the tops thereof fitted with a conventional sound organ, the possibility of unique and pleasant sound production is present. The temperature of the pipes remains below or at the temperature of the air in the room so that a person inadvertently touching the pipes is not burned thereby. Furthermore, a person may position himself considerably closer to the fire since a significant amount of radiant heat energy is absorbed by the pipes and does not pass directly into the room. In this regard also, air passing from the room between the pipes and into the fire is preheated. The heating device might further include an adjustable member to regulate the amount of cooler air entering the pipes so that the amount of air heated is varied and the temperature of the pipes is also alterable, assuming the same amount of radiant energy is being produced by the fire.

An additional significant feature of this invention is the hinge configuration which permits a quick and efficient construction of the device. The hinges also permit the device to be readily adaptable for use with various sizes and contours of fireplaces since the length can be easily varied by adding or removing pipes and their supporting units. Also, the hinge construction allows folding of the device to access the fire and enable the supporting units and pipes to be placed in non-axial alignment with respect to each other, such as in the form of a semicircle or a semiellipse.

The invention has been described in detail with particular reference to a plurality of embodiments thereof, but it will be understood that variations and modifications can be effected within the spirit and scope of the invention.

I claim:

1. A heating device for the conversion of radiation heat into convection heat adaptable for use with a source of radiant energy located in a room, comprising:

supporting means positioned exteriorly of the radiant energy source on a supporting surface, said supporting means including a threshold unit having an opened channel adjacent the supporting surface; and a plurality of spaced pipes extending from the supporting surface for absorbing radiant energy from the source of radiant energy while supported by said supporting means, each of said pipes having a first end for receiving relatively cool air and a second end for discharging the air after the air has been heated by said pipes, said pipes acting to rapidly deliver the heated air to the room so that the heated air circulates therethrough to heat the same, said threshold unit extending between said pipes and preventing the passage of air between bottom portions of said pipes into the source of radiant energy, said opened channel of said threshold unit facing forwardly of said pipes away from the source of the radiant energy to receive in a direction substantially perpendicular to the longitudinal extent of said pipes the relatively cool air which then enters said first ends of said pipes.

2. The device, as claimed in claim 1, wherein:

at least a first row of pipes and a second row of pipes are provided, said second row of pipes being positioned behind said first row of pipes.

3. The device, as claimed in claim 2, wherein:

said pipes are parallel with respect to each other and the pipes of said second row are disposed in horizontal staggered relationship with respect to said pipes of said first row.

4. The device, as claimed in claim 2, wherein:

said pipes of said first row and said pipes of said second row cross each other.

* * * * *